US007610707B1

(12) United States Patent
Payne

(10) Patent No.: US 7,610,707 B1
(45) Date of Patent: Nov. 3, 2009

(54) COMBINED FILE FLAGGING DEVICES AND LABEL HOLDERS

(76) Inventor: Edward A. Payne, 905 W. Riverside Ave., #406, Spokane, WA (US) 99203

( * ) Notice: Subject to any disclaimer, the term of this patent is extended or adjusted under 35 U.S.C. 154(b) by 145 days.

(21) Appl. No.: 11/583,536

(22) Filed: Oct. 18, 2006

Related U.S. Application Data

(63) Continuation of application No. 10/873,342, filed on Jun. 21, 2004, now abandoned.

(51) Int. Cl.
*G09F 23/10* (2006.01)

(52) U.S. Cl. ..... 40/641; 40/359; 283/36

(58) Field of Classification Search ..... 40/641; 116/327, 313, 322, 324
See application file for complete search history.

(56) References Cited

U.S. PATENT DOCUMENTS 1,008,352 A * 11/1911 Meyers, J. M. ..... 40/360
1,768,767 A 7/1930 Howard
2,878,814 A 3/1959 Consaul
2,895,448 A 7/1959 Haines
4,637,149 A 1/1987 Rivkin
4,687,227 A 8/1987 Kehoe
4,905,393 A 3/1990 Laurie
4,951,408 A 8/1990 Banks
4,970,984 A 11/1990 Vasquez
5,056,825 A 10/1991 Templet
5,140,934 A 8/1992 Pennelle
5,287,414 A 2/1994 Foster
5,513,459 A 5/1996 Schneider
5,771,003 A 6/1998 Seymour
5,836,098 A 11/1998 Carney
5,890,307 A 4/1999 Chappelle
5,942,293 A 8/1999 Occhipinti et al.
6,127,928 A 10/2000 Issacman et al.
6,138,900 A 10/2000 Zeller
6,279,299 B1 8/2001 Lee
6,332,285 B1 12/2001 Aadenberg et al.
6,883,460 B2 * 4/2005 Weisenfeld ..... 116/313
6,976,449 B2 12/2005 Weiserfeld

OTHER PUBLICATIONS

U.S. Appl. No. 10/628,190, filed Jul. 28, 2003, Weisenfeld.
U.S. Appl. No. 10/817,996, filed Apr. 5, 2004, Weisenfeld.

* cited by examiner

*Primary Examiner*—Cassandra Davis
(74) *Attorney, Agent, or Firm*—Gregory IPL, P.C.; Randy A. Gregory

(57) ABSTRACT

File flagging apparatuses for hanging and traditional files are shown. The devices have a flag assembly that may be moved between extended and retracted positions. The flagging assemblies may also have a file label holder integrated thereinto. A locking mechanism may be included to keep the flag in position relative to the supporting base or label.

14 Claims, 5 Drawing Sheets

COMBINED FILE FLAGGING DEVICES AND LABEL HOLDERS

CROSS-REFERENCE TO RELATED CASES

This is a continuation of U.S. patent application Ser. No. 10/873,342 filed Jun. 21, 2004 now abandoned and priority thereon under 35 USC § 120 is claimed.

TECHNICAL FIELD

The technical field of this invention is file flagging devices, such as label holding devices with operable flags thereon which can be operated between a conspicuous or extended condition and an unnoticeable or retracted condition.

BACKGROUND OF THE INVENTION

There are many ways to get organized and unfortunately many ways to also get disorganized. One of the most common types of organizational tools are file folders. A popular type of file folder is the hanging file folder. However, traditional pressboard or other types of files are probably used in even greater numbers.

In most of the hanging files there is an array of slots across the top for receiving two insertion arms or other projections of the label holder that are fit into the slots. The mounted label holder is thereby held at each end in reasonably secure mounted relationship with the associated file. Paper labels are typically written or typed upon, and sometimes folded, and then placed into the label holders to indicate the topic of the file.

It is common for people to collect a large number of file folders. Some or all may be labeled using the insertion type label and hanging folders. However, a large collection of any file type makes it difficult to identify or pick out certain files that are in need of attention at different times. Thus, a common technique is to make a separate list of files needing action. This requires added time and can easily be forgotten with regard to one or more entries.

This problem exists for hanging and more traditional style pressboard and other file types. Thus, there remains a need for an improved technique which easily identifies classes of files when stored in a filing array. There also remains a need for an improved folder flagging device having an adjustable flag which can be moved between an attention getting position and an unobservable, retracted position.

BRIEF DESCRIPTION OF THE DRAWINGS

Preferred forms or embodiments of the inventions are explained and characterized herein, often with reference to the accompanying drawings. Such drawings are briefly described below.

DETAILED DESCRIPTION OF THE PREFERRED EMBODIMENTS

Introductory Note

The readers of this document should understand that the embodiments described herein may rely on terminology used in any section of this document and other terms readily apparent from the drawings and language common therefor. This document is premised upon using one or more terms with one embodiment that may also apply to other embodiments for similar structures, functions, features and aspects of the invention. Wording used in the claims is also descriptive of the invention and the text of the claims is incorporated by reference into the description entirely in the form of the claims as originally filed. Terminology used with one, some or all embodiments may be used for describing and defining the technology and exclusive rights associated herewith.

General Configuration

Figure 1:
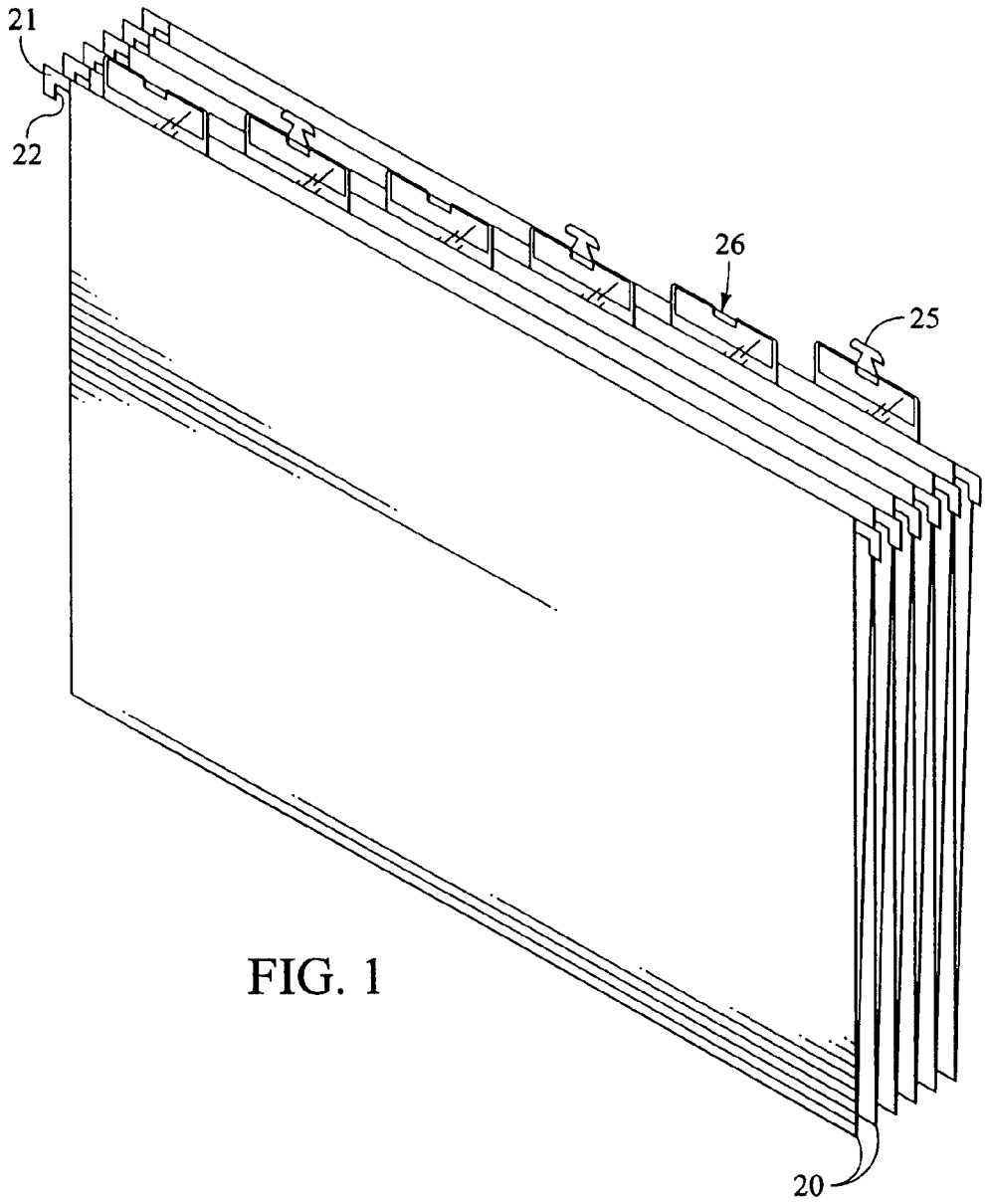
FIG. 1 is a perspective view of a series of hanging file folders with one form of flagging label holders according to the invention mounted upon the files. Some of the label holders have extended flags and others have retracted flags.

FIG. 1 shows a plurality of hanging file folders 20 in positions as they would assume when hanging from the typical hanging file rails (not shown). Files 20 typically have two leaves, each of which have a reinforcing bar 21 at the top edge. The reinforcing bar also preferably includes a hook 22 or other suitably shaped end for engaging the file rails (not shown) and supporting the files thereon in a hanging or suspended condition.

FIG. 1 also shows a plurality of file labels which are made according to the invention. The file labels are designed to hold a paper label insert (not shown). The file labels of FIG. 1 may be adjusted between an extended, flagging position 25 and a retracted, non-flagging position 26.

The flagging position may be used for a variety of purposes, such as flagging a file to be checked at a certain time or upon the occurrence of a certain event. They may also be differently colored or positioned to indicate categories used in the filing system. The flags are preferably colored differently from the remaining parts of the label holder to make them more visible. FIG. 1 does not attempt to show all details of the various embodiments or combinations having the features of the embodiments shown and described in greater detail herein.

Figure 2:
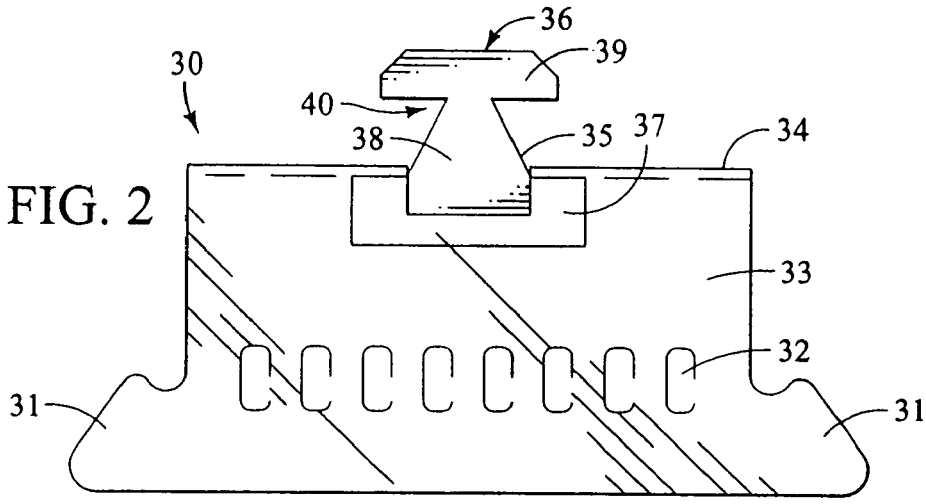
FIG. 2 is a front view of a first label holder according to the invention.
Figure 3:
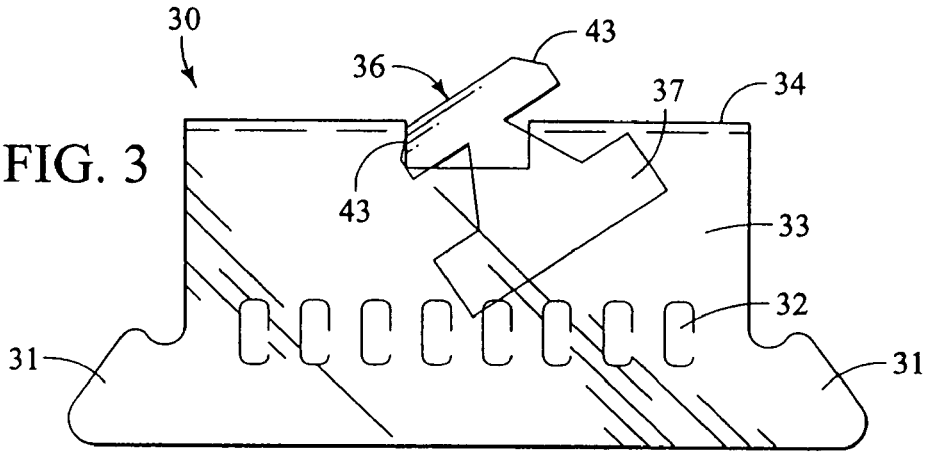
FIG. 3 is a view similar to FIG. 2 with the flag portion of the label holder in the process of being removed or installed.
Figure 4:
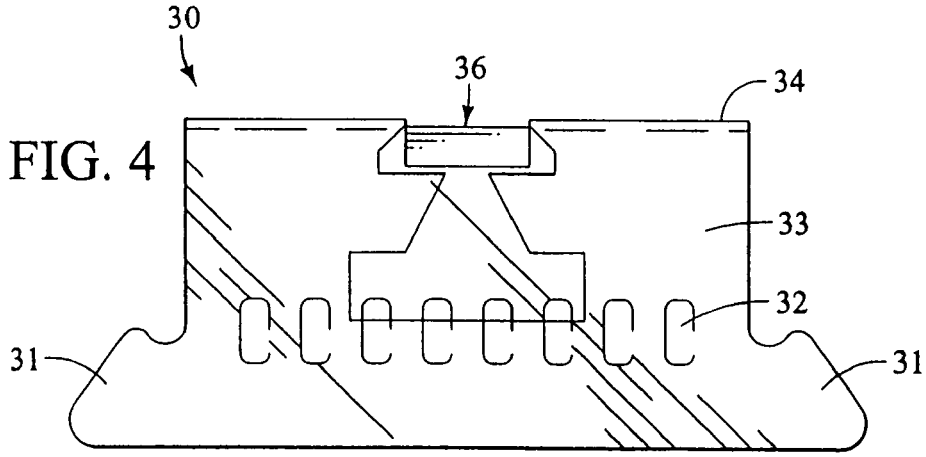
FIG. 4 is a view similar to FIG. 2 with the flag portion of the label holder fully retracted.
Figure 5:
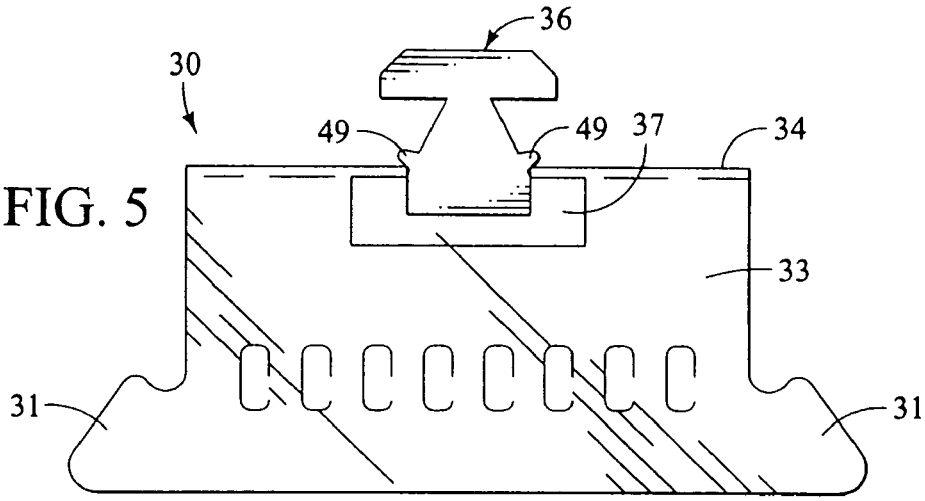
FIG. 5 is an enlarged front view of a second embodiment flagging file label holder according to the invention.
Figure 6:
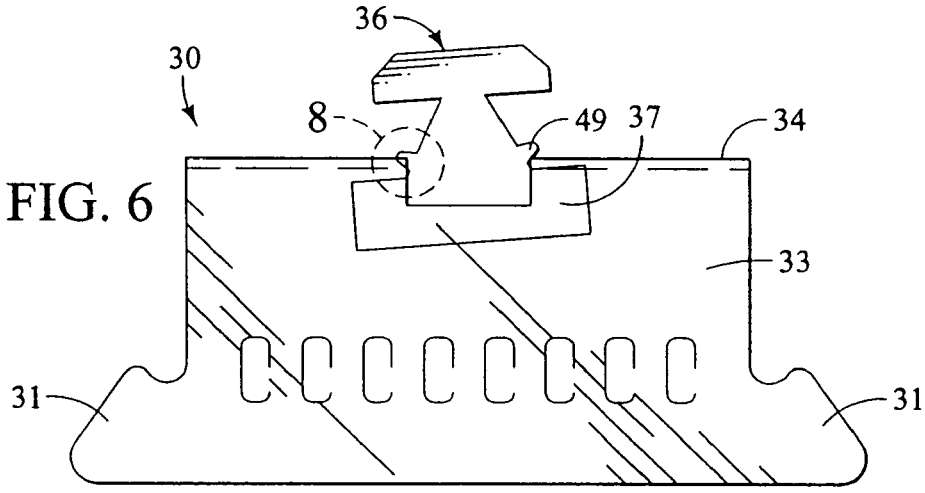
FIG. 6 is a view similar to FIG. 5 with the flag portion of the label holder in the process of being installed or removed.

First Embodiment~FIGS. 2-4

FIGS. 2-4 show one form of the invention illustrating assembly and adjustment of the flag from an extended to a retracted position. The version of FIGS. 2-4 includes a hanging file label 30 having mounting projections 31 at each end to be received in slots of the hanging file (not shown). Apparatus 30 also has holes or distortions 32 which aid in providing flexibility for installing the label holders into the hanging files. In most constructions commercially available, the label holder will have two opposing, similar shaped leaves or layers 33 that are typically joined by a folded joint 34. A paper label with the file topic written, typed or printed thereon is insertable between leaves 33, usually held above holes or distortions 32.

These Figs. show that a flag port 35 may be included to allow a small plastic, paper or other suitable flag 36 to extend upward above the flag port 35. The flag port 35 is open along the folded joint 34 and allows the flag to be partially extended to act as a flag. Notches 40 are preferably included to facilitate handling or manipulation of the flag assembly.

Flag 36 as shown in FIGS. 2-5 has a base 37, tapered neck 38, and flag top 39. An inserted label (not shown) and friction between the label holder and label help to maintain the flag in the desired extended or retracted position. Additionally, the construction of the flag assembly also interacts with the holder to help keep the flag in the retracted position.

FIG. 3 shows the flag 36 tipped to allow the flag to be inserted during assembly or installation. This is done through port 35. The flag can be retracted and hidden as shown in FIG. 4. The back side of part 35 extends further downward in preferred forms to receive the flag portion 39 therein.

To aid in the process of installation, the flag portion 39 has clipped ends 43 that allow one end of the flag portion to dip within the label holder and assume a position between the two layers of the label holder (see FIG. 4). The flag is then squared and positioned in either the extended position of FIG. 2 or retracted into the retracted position of FIG. 4. Flag portion 39 is preferably received in a rear cut-out of approximately the same size when in the retracted position.

Tipping is required to initially install flags into the label holder or to remove the flags. The back panel of the label holder is cut deeper than the front so that the top of the flag stores below the top of the label holder.

To extend the flag, the flag is merely moved upwardly or extended until the installed flag base 37 abuts the fold 34. Once inserted into label holder it needs only to be extended by pulling up or retracted by pushing down so that it stores behind the paper label with the top of the flag advantageously below the top of the file label holder, as shown in FIG. 4.

Second Embodiment~FIGS. 5-8

FIGS. 5-8 show a construction similar to that described with regard to FIGS. 2-4 and similar reference numerals are used for the same or similar parts. That description will not be repeated.

The notable difference in the construction shown in FIGS. 5-8 is that the flag assembly is provided with locking prongs 49 along the neck portion near the base which catch below the fold 34 and provide more secure retainage of the flag to the remaining portions of the label holder.

Figure 7:
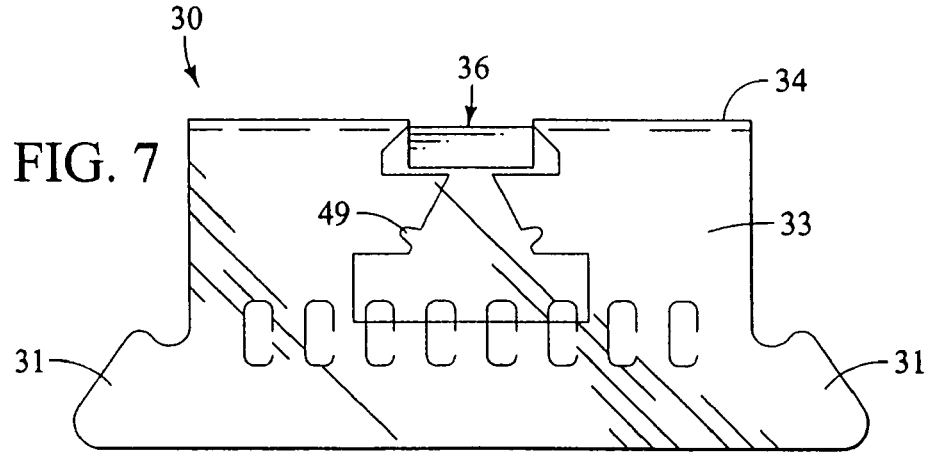
FIG. 7 is a view similar to FIG. 4 with the flag portion of the label holder fully retracted.
Figure 8:
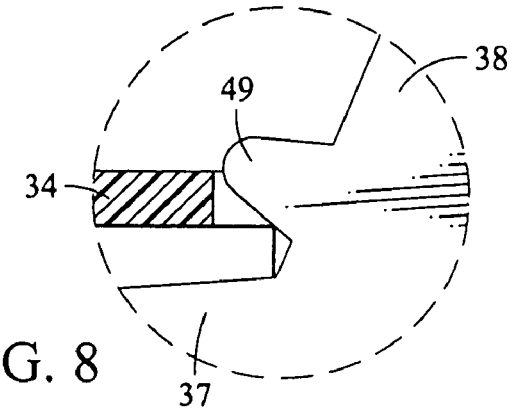
FIG. 8 is an enlarged view taken at circle 8 of FIG. 6.

This embodiment is installed by tilting the flag similar to the embodiment of FIGS. 2-4 with somewhat greater effort used to pass the locking prongs 49 into the port 35. The prongs or fold may distort during this process depending on the size and degree of securement desired for the flag to prevent dislodgement. Any distortion is minimized by placing one prong above the folded joint 34 and then rotating the other prong into an installed position when being assembled. The flag is again tilted to manipulate the other prong past the port opening to achieve full assembly. The flag may then be moved into a retracted position as illustrated in FIG. 7.

Another pivotal motion of the flag assembly causes the flag to assume the retracted position. The flag may then be simply moved up for the extended position of FIG. 5 or depressed downwardly for the retracted position of FIG. 7.

Figure 9:
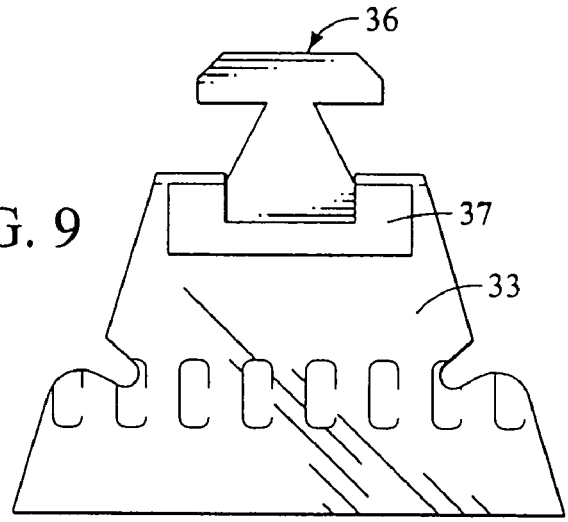
FIG. 9 is a third embodiment of the invention designed to have a smaller width and an adjustable flag. The third embodiment may be a flagging device without practical label holding ability, or a small label may be applied.

Third Embodiment~FIG. 9

The embodiment of FIG. 9 is also similar to those described and similar numbers are used and the description is not repeated except as needed to point out the differences.

The apparatus 30 of FIG. 9 is shorter in length and is designed to serve the singular function of being a flagging apparatus. It does not receive a label or can only receive a shortened label.

The label holder of FIG. 9 is smaller in width and thus allows more flagging columns to be formed in a file array. Otherwise it is constructed, assembled, operated and dismantled in the same manner as described for the embodiment of FIGS. 2-5.

Figure 10:
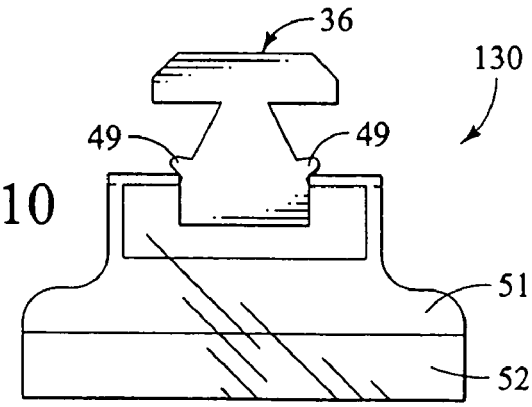
FIG. 10 is a fourth embodiment of the invention designed to adhere to a file folder without the necessity of having files with pre-cut label holder mounting apertures, such as typical pressboard files without label slots.

Fourth Embodiment~FIG. 10

FIG. 10 shows an adjustable flagging device similar to that shown in FIG. 9, but the flagging device 130 is provided with at least one or more, preferably two, leaves 51 having at least one, preferably two, adhesive strips 52 that are designed to adhere to a file cover or other file leaf. The label holder is preferably provided with two leaves 51 with adhesive 52 on both inside surfaces so that the label is held from both sides of the file cover, or at other suitable or desired locations upon a file folder.

The flagging device 130 is provided with locking projections 49, such as described in connection with the embodiment of FIGS. 5-8. The description given above explains the construction, assembly, operation and disassembly, and such will not be repeated here.

The flagging device 130 is intended for use on standard file folders and allows a flagging device to be attached thereto, preferably by adhesion. The device may have adhesive strip covers which are peeled away at the time of application to the file folder. The leaf or leaves with adhesive are pressed against a leaf of a file. This is preferably done so with front and back leaves 33 of the flagging device adhere to opposing sides of the file leaf to which they are being adhesively mounted.

Figure 11:
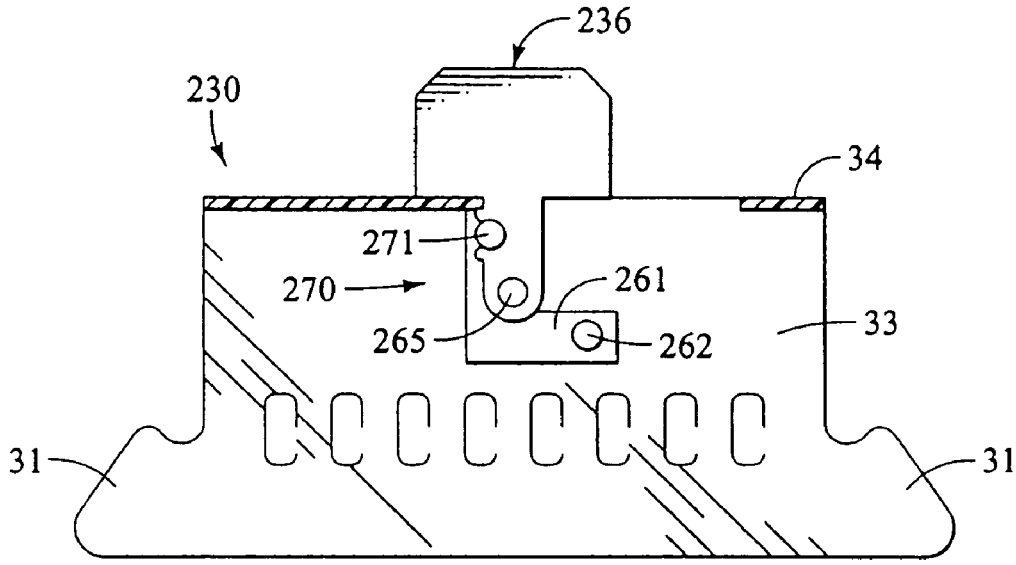
FIG. 11 is a fifth embodiment of the invention having a different design for the flag and flag mount. The flag is shown in the extended position.
Figure 12:
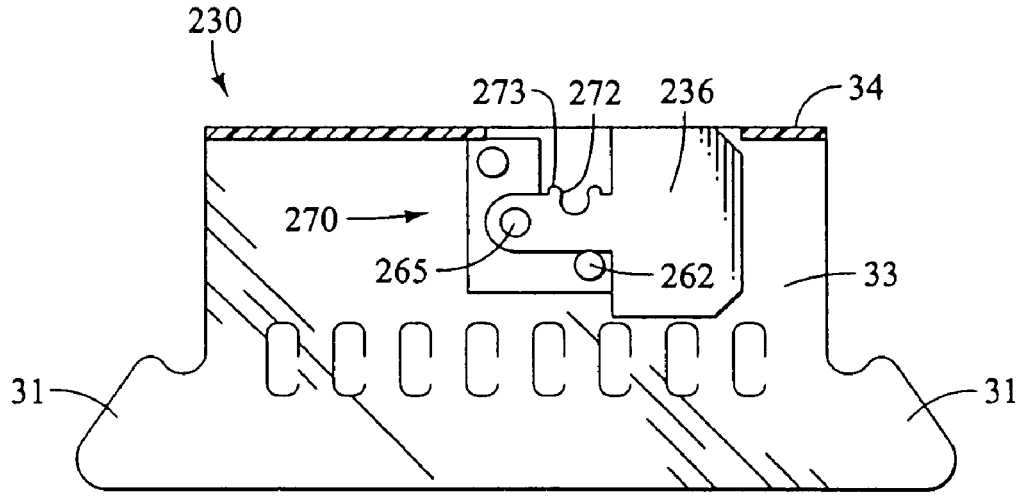
FIG. 12 is the fifth embodiment label holder of FIG. 11 with the flag pivoted into a retracted position.

Fifth Embodiment~FIGS. 11 and 12

FIGS. 11 and 12 show another form expressing the concepts of the inventions described in this application. The insertable label holder 230 is similar to the first and second embodiments with a more robust flag 236 which is pivotally mounted to the base of the flagging and label holding apparatus.

As shown, the apparatus 230 includes a flag mount 261 which may be adhered, riveted or connected by both rivets 262 and 271 together with adhesive. Mount 261 has a flag pivot pin or shaft 265 about which or together with the flag assembly 236 pivots between extended and retracted positions.

The latch pin 271 and pivot pin 265 may be mounted to the label holder so as to help keep mount 261 positioned and mounted thereon.

The flagging assembly may advantageously include a latch 270 to hold the flag in a desired position, such as the extended position. As shown, the latch has a latch pin 271 which is engaged by a latch receptacle 272 formed into the shank of the flag assembly. The receptacle may have extensions 273 to improve latching capability.

Further Aspects and Features

The above description has set out various features and aspects of the invention and the preferred embodiments thereof. Such aspects and features may further be defined according to the following claims which may individually or in various combinations help to define the invention.

Interpretation Note

The invention has been described in language directed to the current embodiments shown and described with regard to various structural and methodological features. The scope of protection as defined by the claims is not intended to be necessarily limited to the specific features shown and described. Other forms and equivalents for implementing the inventions can be made without departing from the scope of concepts properly protected hereby.

I claim:

1. An apparatus for holding a label and being adjustably controllable to flag or not flag a file folder upon which the apparatus may be mounted, comprising:

a label holder having two leaves between which a label may be inserted if desired;

a flag mounting body secured to the label holder;

at least one flag mounted upon said flag mounting body for pivotal movement thereon between a retracted position wherein said at least one flag is retracted and an extended position wherein said at least one flag is extended to increase visibility of the at least one flag;

a latch pin mounted to the mounting body;

a latch receptacle formed into the flag in a position so that the latch pin and latch receptacle engage and latch together when the at least one flag is extended into the extended position;

wherein said latch pin is cylindrical.

2. An apparatus for holding a label and being adjustably controllable to flag or not flag a file folder upon which the apparatus may be mounted, comprising:

a label holder having two leaves between which a label may be inserted if desired; a flag mounting body secured to the label holder;

at least one flag mounted upon said flag mounting body for pivotal movement thereon between a retracted position wherein said at least one flag is retracted and an extended position wherein said at least one flag is extended to increase visibility of the at least one flag;

a latch pin mounted to the mounting body;

a latch receptacle formed into the flag in a position so that the latch pin and latch receptacle engage and latch together when the at least one flag is extended into the extended position;

wherein said latch receptacle has at least one extension adjacent thereto which increases the latching capability.

3. An apparatus according to claim 2 wherein said at least one extension adjacent the latch receptacle has extensions at each side of the latch receptacle which increase the latching capability.

4. An apparatus for holding a label and being adjustably controllable to flag or not flag a file folder upon which the apparatus may be mounted, comprising:

a label holder having two leaves between which a label may be inserted if desired;

a flag mounting body mounted between said two leaves of the label holder;

at least one flag mounted upon said flag mounting body for pivotal movement thereon between a retracted position wherein said at least one flag is retracted and contained within said label holder and an extended position wherein said at least one flag is extended exteriorly from said label holder to increase visibility of the at least one flag;

a latch pin mounted to the mounting body;

a latch receptacle formed into the flag in a position so that the latch pin and latch receptacle engage and latch together when the at least one flag is extended into the extended position;

further comprising a piece against which the flag rests when in the retracted position.

5. An apparatus for holding a label and being adjustably controllable to flag or not flag a file folder upon which the apparatus may be mounted, comprising:

a label holder having two leaves between which a label may be inserted if desired;

a flag mounting body mounted between said two leaves of the label holder;

at least one flag mounted upon said flag mounting body for pivotal movement thereon between a retracted position wherein said at least one flag is retracted and contained within said label holder and an extended position wherein said at least one flag is extended exteriorly from said label holder to increase visibility of the at least one flag;

a latch pin mounted to the mounting body;

a latch receptacle formed into the flag in a position so that the latch pin and latch receptacle engage and latch together when the at least one flag is extended into the extended position;

wherein the flag mounting body is mounted between said two leaves of the label holder.

6. An apparatus according to claim 5 wherein said flag extends from between the two leaves.

7. An apparatus according to claim 5 wherein the flag mounting body is mounted between said two leaves of the label holder said label holder being formed by a folded piece and the at least one flag extends upward through at least one port formed through the folded piece forming the label holder.

8. An apparatus for flagging a file by adjustable control to raise a flag or retract a flag and which is adapted for use upon a file folder upon which the apparatus may be mounted, comprising:

a flag mounting body;

at least one flag mounted upon said flag mounting body for pivotal movement thereon between a retracted position wherein said at least one flag is retracted and an extended position wherein said at least one flag is extended to increase visibility of the at least one flag;

a latch pin mounted to the mounting body;

a latch receptacle formed into the flag in a position so that the latch pin and latch receptacle engage and latch together when the at least one flag is extended into the extended position;

wherein said latch receptacle has at least one extension adjacent thereto which increases the latching capability.

9. An apparatus according to claim 8 wherein said at least one extension adjacent the latch receptacle has extensions at each side of the latch receptacle which increase the latching capability.

10. An apparatus for flagging a file by adjustable control to raise a flag or retract a flag and which is adapted for use upon a file folder upon which the apparatus may be mounted, comprising:

a flag mounting body;

at least one flag mounted upon said flag mounting body for pivotal movement thereon between a retracted position wherein said at least one flag is retracted and contained within said label holder and an extended position wherein said at least one flag is extended exteriorly from said label holder to increase visibility of the at least one flag;

a latch pin mounted to the mounting body;

a latch receptacle formed into the flag in a position so that the latch pin and latch receptacle engage and latch together when the at least one flag is extended into the extended position;

further comprising a piece against which the flag rests when in the retracted position.

11. An apparatus for flagging a file by adjustable control to raise a flag or retract a flag and which is adapted for use upon a file folder upon which the apparatus may be mounted, comprising:

a flag mounting body;

at least one flag mounted upon said flag mounting body for pivotal movement thereon between a retracted position wherein said at least one flag is retracted and an extended position wherein said at least one flag is extended to increase visibility of the at least one flag;

a latch pin mounted to the mounting body;

a latch receptacle formed into the flag to hold the flag in a desired position; wherein said latch pin is cylindrical.

12. An apparatus for flagging a file by adjustable control to raise a flag or retract a flag and which is adapted for use upon a file folder upon which the apparatus may be mounted, comprising:

a flag mounting body;

at least one flag mounted upon said flag mounting body for pivotal movement thereon between a retracted position wherein said at least one flag is retracted within and an extended position wherein said at least one flag is extended to increase visibility of the at least one flag;

a latch pin mounted to the mounting body;

a latch receptacle formed into the flag to hold the flag in a desired position;

wherein said latch receptacle has at least one extension adjacent thereto which increases the latching capability.

13. An apparatus according to claim 12 wherein said latch receptacle has extensions at each side of the latch receptacle which increase the latching capability.

14. An apparatus according to claim 12 and further comprising a piece against which the flag rests when in the retracted position.

* * * * *